US011555665B2

(12) United States Patent
Richmond

(10) Patent No.: US 11,555,665 B2
(45) Date of Patent: Jan. 17, 2023

(54) ARCHERY ARROW PULLER

(71) Applicant: Ronald Scott Richmond, White Lake, MI (US)

(72) Inventor: Ronald Scott Richmond, White Lake, MI (US)

( * ) Notice: Subject to any disclaimer, the term of this patent is extended or adjusted under 35 U.S.C. 154(b) by 119 days.

(21) Appl. No.: 17/067,651

(22) Filed: Oct. 10, 2020

(65) Prior Publication Data

US 2022/0113110 A1 Apr. 14, 2022

(51) Int. Cl.
*F41B 5/14* (2006.01)

(52) U.S. Cl.
CPC ..... *F41B 5/1465* (2013.01); *F41B 5/14* (2013.01); *F41B 5/1442* (2013.01)

(58) Field of Classification Search
CPC ..... F41B 5/1465; F41B 5/14; F41B 5/1442; Y10T 29/53848; Y10T 29/53883; Y10T 29/53896
USPC ..... 294/217; 81/57.18, 128, 129.5, 142
See application file for complete search history.

(56) References Cited

U.S. PATENT DOCUMENTS 709,014 A 9/1902 Jacobs
1,563,840 A * 12/1925 Dirks ..... B25B 27/08 29/247
1,680,631 A * 8/1928 Palaith ..... B23B 31/1253 279/58
1,976,253 A * 10/1934 Clark ..... B05C 17/0123 222/391
2,582,417 A * 1/1952 Croessant ..... B25B 27/14 72/391.2
2,710,520 A * 6/1955 Selzler ..... B21L 15/00 254/123
3,826,471 A * 7/1974 Orton ..... B25B 27/02 254/131
3,863,322 A * 2/1975 Russell ..... B25B 27/023 29/283
4,822,088 A * 4/1989 Price ..... A01B 1/165 294/50.7
4,920,625 A * 5/1990 Smith ..... B25B 27/023 29/256
4,932,638 A * 6/1990 Chen ..... B25B 27/0007 269/6

(Continued)

FOREIGN PATENT DOCUMENTS

DE 202016105445 * 1/2017 ..... F41B 5/1465

OTHER PUBLICATIONS

P.J. Reilly Dec. 4, 2015 Large Diameter Arrows For Indoor Target Shooting Web page: /lancasterarchery.com/blog/large-diameter-arrows-for-indoor-target-shooting/.

(Continued)

*Primary Examiner* — John E Simms, Jr.

(57) ABSTRACT

An archery arrow/bolt pulling device designed for the safe, easy, non-destructive and one handed extraction of deeply embedded, complete arrow or bolt assemblies regardless of shaft diameter or arrowhead type from foam and other target materials. This device pulls with three surrounding gripping jaws in a coaxial path with the long axis of the arrow/bolt and the combined mechanical advantage power of lever, fulcrum and cam while overcoming the minimal movement of the load end of the lever by means of a ratcheting pawl and toothed pull rod.

18 Claims, 7 Drawing Sheets

(56) References Cited

U.S. PATENT DOCUMENTS 5,301,924 A * 4/1994 Kammerer ..... B25B 27/02 254/131
5,445,424 A * 8/1995 Binette ..... B25G 1/102 294/102.1
5,448,816 A * 9/1995 Hill, Jr. ..... A43D 5/005 29/239
5,546,621 A * 8/1996 Bulot ..... F41B 5/1465 140/123
D373,610 S 9/1996 Ravencroft
5,727,298 A * 3/1998 Strong ..... B25B 27/023 29/259
5,794,918 A * 8/1998 Price ..... E04H 17/265 254/113
5,934,001 A 8/1999 Pace et al.
7,234,219 B2 6/2007 Deiter
8,544,926 B2 10/2013 Braswell
2003/0074776 A1* 4/2003 Miles ..... B25B 27/02 29/267
2007/0018144 A1* 1/2007 Saavedra ..... E04H 17/265 254/30
2007/0209182 A1* 9/2007 De Buyer-Mimeure ..... B26B 29/02 29/264
2011/0010906 A1* 1/2011 Mitchell ..... F16D 65/0043 29/270
2012/0167707 A1* 7/2012 Chang ..... F16G 11/12 74/491
2012/0193853 A1* 8/2012 Patel ..... B25B 5/068 269/6
2012/0292935 A1* 11/2012 Bierfreund ..... F41B 5/1465 294/99.1
2015/0021946 A1* 1/2015 Vierke ..... E21B 19/07 294/86.24
2015/0246436 A1* 9/2015 Huang ..... B25B 27/062 29/256
2019/0084164 A1* 3/2019 Mounsdon ..... F41B 5/1465

OTHER PUBLICATIONS

Easton Archery Jun. 6, 2016 Web page: /eastonarchery.com/huntingarrows/.

* cited by examiner

ARCHERY ARROW PULLER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The "arrow" from a bow and the "bolt" or "quarrel" from a crossbow being completely interchangeable in the context of this invention shall herein be succinctly called "arrow" and shall not limit this "Archery Arrow Puller" to one or the other.

This invention relates generally to archery bows, crossbows and their details. More specifically it relates to a device for the safe and non-destructive removal of an arrow from foam and other target materials without the need for disassembly of said arrow. "Non-destructive" in this context includes but is not limited to the avoidance of bending, cracking, crushing or breaking of the arrow shaft and/or damage to the fletching, knock or arrowhead. Any of which would be detrimental to the re-use or accuracy of said arrow making archery practice impracticable. "Safe" in this context considers the avoidance of bodily harm by eliminating the extreme force one must use to extract said arrows from said targets and the opposite reaction that occurs when and if the arrow breaks or breaks free. Especially those with razor broadheads.

The advanced technology of modern compound bows and carbon fiber arrows has dramatically increased arrow impact (kinetic energy) and the depth and speed of penetration the arrow has on said targets. The smaller diameter and stiffness of spine of carbon fiber arrows adds to the problem of arrow removal from said targets in the following three ways; 1) stiffness of spine causes deeper target penetration due to less deflection of the arrow shaft upon impact of said targets, 2) the smaller diameter of carbon fiber arrows cause for less surface area to meet with friction during the penetration of said targets and, 3) the smaller diameter of carbon fiber arrows makes them very hard to grasp with your hands during the removal from said targets. The arrow speed and arrow efficiency brought forth from this advanced archery technology causes extreme friction as a loosed arrow penetrates said target. Interaction of these asperities through elastic and plastic yielding generates heat which creates a bond (friction weld) between arrow and said target.

Another issue exposed itself upon the initial design of such an arrow pulling device. Grasping the said arrow in a non-destructive way with enough surface area on the arrow shaft to hold firmly enough caused some of the previous inventions to encircle the arrow with semi cylindrical shaped grippers. Deiter U.S. Pat. No. 7,234,219 B2 is one such example. Braswell U.S. Pat. No. 8,544,926 B2 is another. While this semi cylindrical shaped gripper design does ensure maximum gripping surface on a similarly sized arrow, it does not lend itself well to the wide range of arrow shaft diameters. A study of arrow shaft materials (aluminum, carbon fiber, fiberglass, hybrid, wood etc.) and subsequent diameter of the arrow shafts showed a wide range of diameters (approximately 5 mm~10 mm O.D.). Online references: lancasterarchery.com/blog/large-diameter-arrows-for-indoor-target-shooting/eastonarchery.com/huntingarrows/Inspirational reference: A. I. Jacobs U.S. Pat. No. 709,014.

The necessity for non-destructive arrow removal from said targets has driven several inventors to apply an array of solutions, none of which encompass in totality the requirements met in this invention. Numerous arrow pulling devices are found in the current state of the art. Ravencroft, U.S. Pat. No. D373,610, discloses an arrow gripping tool to help the hand grab or grip an arrow embedded in the target. While Ravencroft's invention improves traction on the arrow shaft, it does not provide a mechanical advantage to amplify the force needed to remove today's deeply embedded arrows. Orton et al. U.S. Pat. No. 3,826,471, discloses a tool for extraction of an arrowhead. Orton's device does provide an amplifying mechanical advantage by means of a lever and fulcrum while grasping the arrowhead rather than the arrow shaft. While this provides protection for the arrow shaft, it would be impossible to grasp an arrow head that is deeply embedded (unreachable) in the archery target. Binette U.S. Pat. No. 5,445,424 device features a ramp clamping system that does grasp the arrow shaft rather than the unreachable arrowhead. However, it's acceptance of the wide range of arrow shaft diameters seems limited and there is no mechanical advantage in its arrow removal technique. Smith U.S. Pat. No. 4,920,625 exhibits a nice use of mechanical advantage via a threaded screw system. Unfortunately, the device can not access an arrowhead which is deeply submerged in the target material and also requires disassembly of the arrow. Pace et al. U.S. Pat. No. 5,934,001 uses a sliding hammer or tamping rod device as a mechanical advantage but necessitates arrow disassembly and can not access a deeply embedded arrowhead. While this sliding hammer pulling device is extremely effective in extracting the arrowhead alone, this style of mechanical advantage does not lend itself well to the arrow shaft pulling device as the shock of each hammer stroke may separate the threaded insert which is only glued to the inside wall of the arrow and allows for the attachment of the arrowhead to the arrow. Inspirational reference: S. Clark U.S. Pat. No. 1,976,253.

BRIEF SUMMARY OF THE INVENTION

An ergonomic pistol gripped mechanical aid for the safe, easy, one handed and non-destructive extraction of a complete arrow assembly regardless of arrow head type embedded in foam or other target materials. Three jaws, lined with a non-marring gripping surface, automatically deployed and self clamping through angled ramps to a vast array of arrow diameters, clamp the arrow when the operator depresses the squeeze trigger. Meanwhile, the clamping jaw assembly (with arrow) is pulled rearward with an amplified mechanical advantage (lever, fulcrum and cam) while the muzzle face pushes against the target in an equal and opposite reaction. All motions, clamping, pulling the arrow and pushing against the target happening simultaneously while the squeeze trigger is being depressed. Multiple squeezes of the trigger forcing the clamp assembly continuously rearward on a coaxial (improvement from parallel) path with the arrow until it has been pulled or freed from the target.

The object of this invention is multi-layered; a) To avoid personal injury from the process of trying to remove arrows that seem to "weld" themselves in to foam and other target materials. b) Extraction of costly arrows so one can afford to practice archery. c) Extraction of arrows so one does not shoot and damage previously shot arrows through collision. d) Easy extraction of arrows so one does not over exert oneself or in the case that one doesn't have the physical strength. e) One handed extraction with a coaxial pull path for ease of use and avoidance of arrow damage. f) Acceptance of the wide range of available arrow shaft diameters. g) Proof of concept in which a fully working prototype was designed and built while learning CNC programming/machining at a friends machine shop.

BRIEF DESCRIPTION OF THE SEVERAL VIEWS OF THE DRAWING

FIG. 7A Section A-A and 7B together describe and discern the difference between the squeeze trigger pivot boss as opposed to the squeeze trigger retainer screw.

DETAILED DESCRIPTION OF THE INVENTION

This invention discloses an ergonomic, safe and portable design for a device through which an amplified mechanical advantage using a lever and a cam allows for the operator with one hand to easily extract a deeply embedded arrow from foam targets and other objects, regardless of the type of arrowhead and without disassembly or damage to said arrow. This is done by positioning said device (see FIG. 1) around the side of an embedded arrow while placing the muzzle face 1A against said target and depressing the squeeze trigger 8. Three gripping jaws being equally spaced around the arrow automatically deploy. As the squeeze trigger 8 is depressed the jaws move inward on clamping ramps, increasing their grip as pressure on the squeeze trigger is applied, grasp the arrow shaft and are pulled rearward by the motion of the squeeze trigger 8 through a lever and ratcheting pawl setup (soon defined). This in turn forces the muzzle face 1A to push against the said target in an equal and opposite direction, pulling the arrow free slowly and most importantly, safely.

Figure 1:
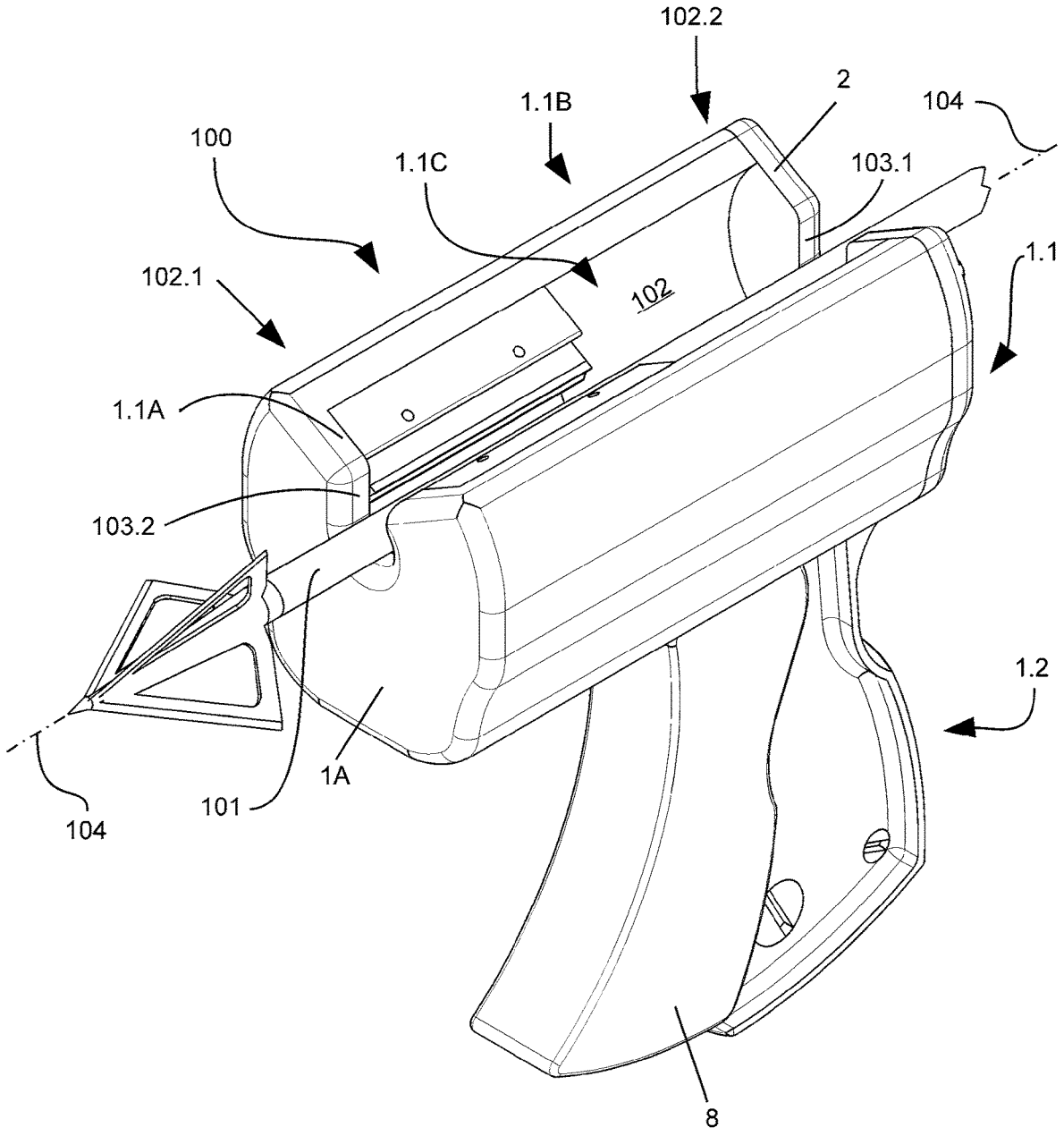
FIG. 1 is an isometric view of the arrow puller showing the pistol grip shape and ergonomic aspects while depicting an arrow in position for clarity.

FIG. 1 is an isometric view of the arrow puller showing the overall shape and ergonomic pistol grip while depicting an arrow in position for clarity. The muzzle face 1A surrounds the arrow and pushes against the target ensuring a coaxial pull axis with the arrow. The muzzle face 1A and the breech block 2 are both designed with U shaped guides to help position the arrow prior to squeezing/clamping/pulling.

Figure 2:
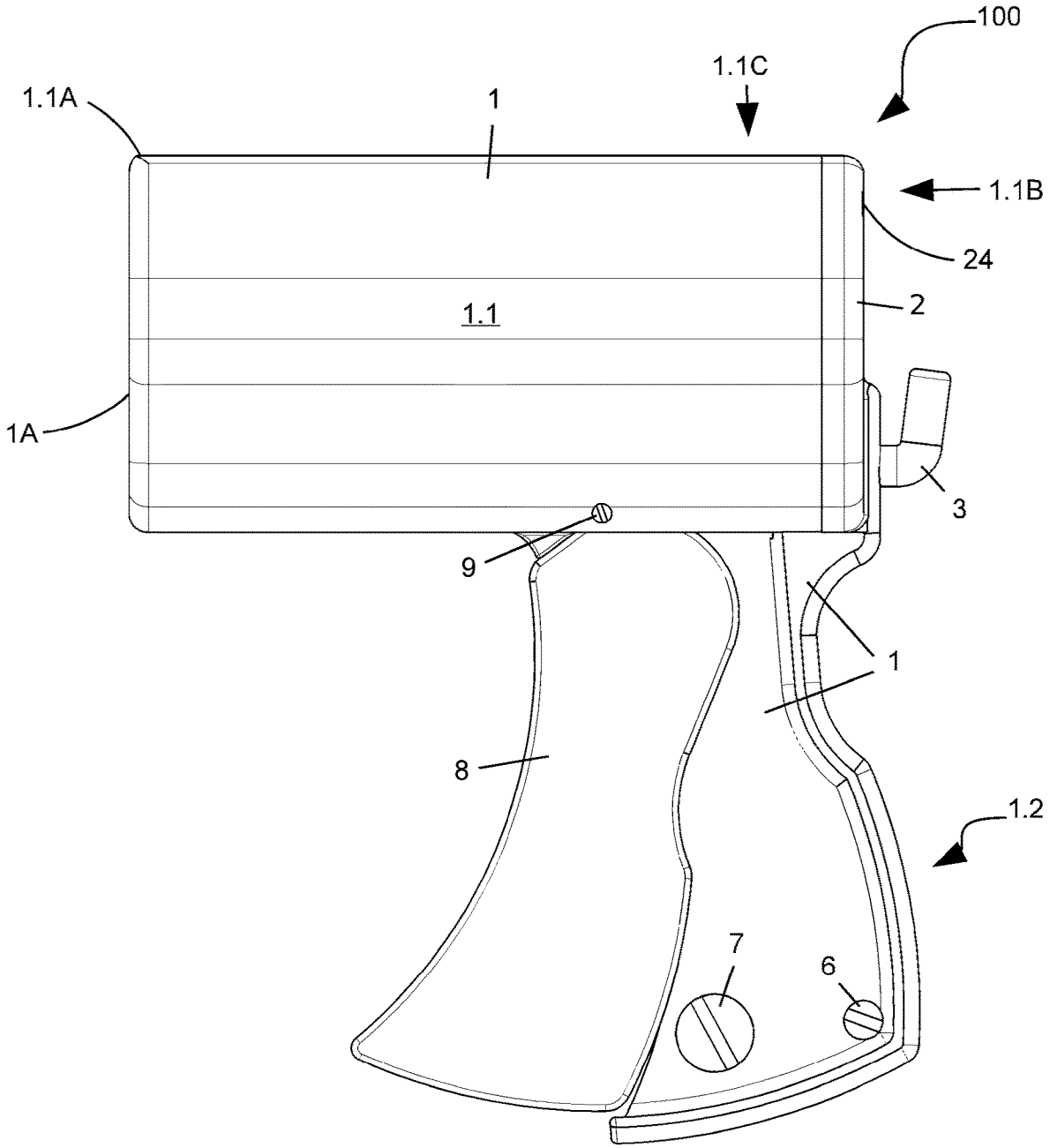
FIG. 2 is a left side elevation view of the arrow puller referencing the external components of the device.

FIG. 2 is a left side elevation view showing most of the external components; frame 1, breech block 2, pull rod 3, trigger spring retainer screw 6, transfer arm pivot screw 7, squeeze trigger 8 and squeeze trigger retainer screw 9. All of these components and their function will soon be explained in detail as internal components and their role in the kinematics become exposed.

Figure 3A:
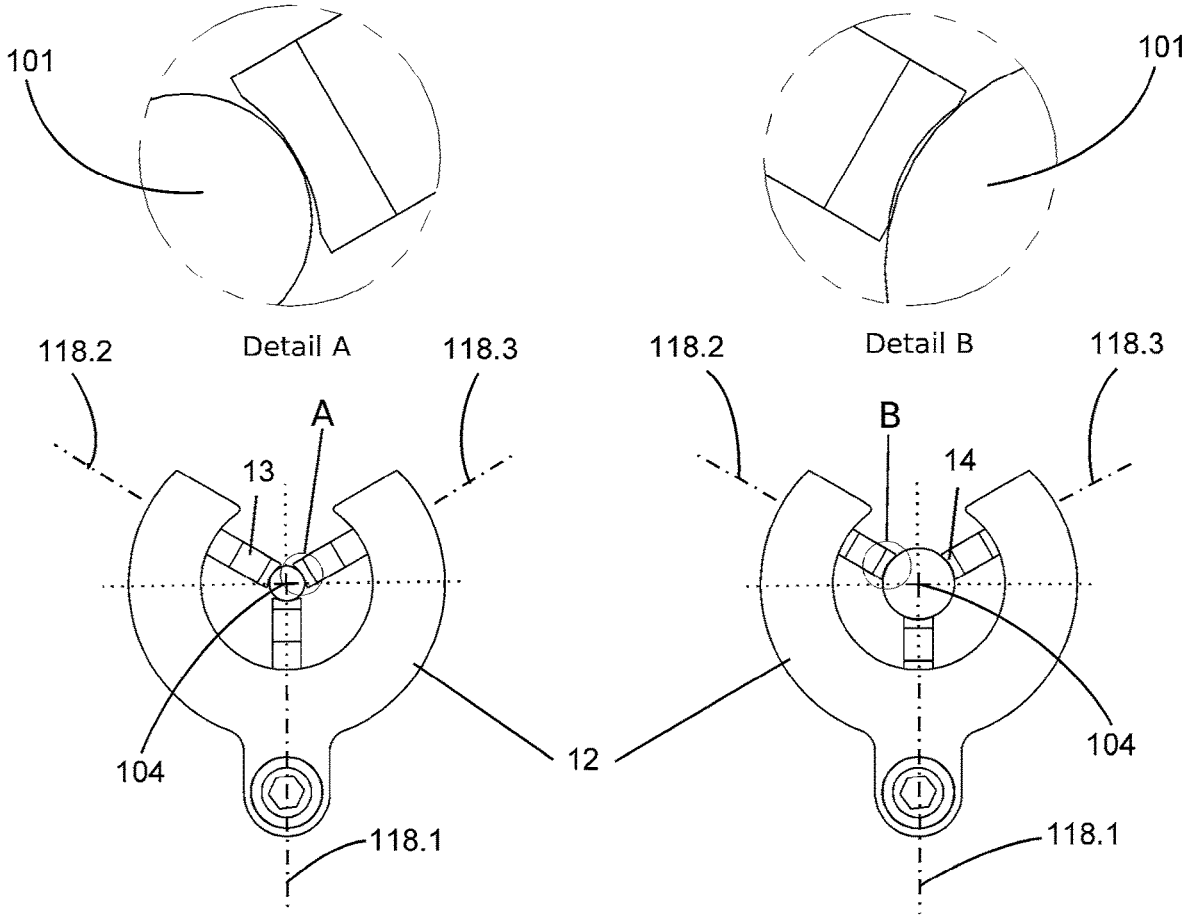
FIG. 3A is a front elevation view of the internal jaw holder assembly. This view depicts three important things: 1) the large range of arrow diameters studied in the development of this device, 2) the novel three jaw approach for accommodating such a large range of diameters and 3) references to the key arrow grasping components of the jaw holder assembly. Also shown in FIG. 3A are Detail Views A and B.
Figure 3B:
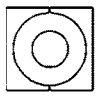
FIGS. 3B and 3C are front elevation view mock-ups depicting the contrast of the smallest and largest common arrow diameters and how the semi cylindrical gripping technique of some of the previous state of the art did not accommodate for this variance.
Figure 3C:
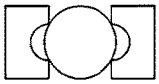

The process of pulling an embedded arrow starts with grasping it first, as should the process of describing it in detail. FIG. 3A depicts two front views of the same one jaw holder 12 albeit, in two different scenarios; 1) grasping the smallest arrow on the left and 2) grasping the largest arrow on the right. Smallest and largest arrow diameters (5~10 mm) are based on the study mentioned in paragraph 0004 of this specification. The three jaws 13 slide toward or away from the arrow on angled clamping ramps (hidden in this view) while always staying parallel to the arrow. The jaw grips 14 being vulcanized, glued, molded or otherwise attached to the jaws 13. The jaw grips 14 being a medium to low durometer rubber or other semi-tacky non-marring material and bearing a 3.75 mm radius groove down the face that meets the arrow. The 3.75 mm radius dimension derives from 5 mm plus 10 mm arrow diameter range divided by 2 equals 7.5 mm average arrow diameter divided by 2 is the radius. This along with deflection of the jaw grips 14 when clamped ensures the most surface area over the entire range of arrow diameters as seen in both Detail A and Detail B. FIGS. 3B and 3C are front elevation view mock-ups depicting the contrast of the smallest and largest common arrow diameters and how the semi cylindrical gripping technique of some previous state of the art did not accommodate for this variance. FIG. 3B specifically depicts a semi cylindrical grip designed for the largest arrow diameter and its inability to even make contact with the smallest arrow diameter. FIG. 3C specifically depicts a semi cylindrical grip designed for the smallest arrow diameter and its inability to make sufficient contact with the largest arrow diameter. Overall, drawing number 3/7 and it's three views show how this design accommodates all common arrow sizes and its proportions could easily be adjusted for any future changes in arrow technology. Also depicted is the beveled opening in the jaw holder 12 between the top two jaws 13 allowing for easy positioning of the device around an embedded arrow without having to slide it over the fletching. This beveled opening also allows for the manipulation of this device to engage with an arrow that's embedded in said target side by side with another arrow. Implicit in FIG. 3A is the clamping pattern that triangulates the arrow to avoid crushing it.

Figure 4:
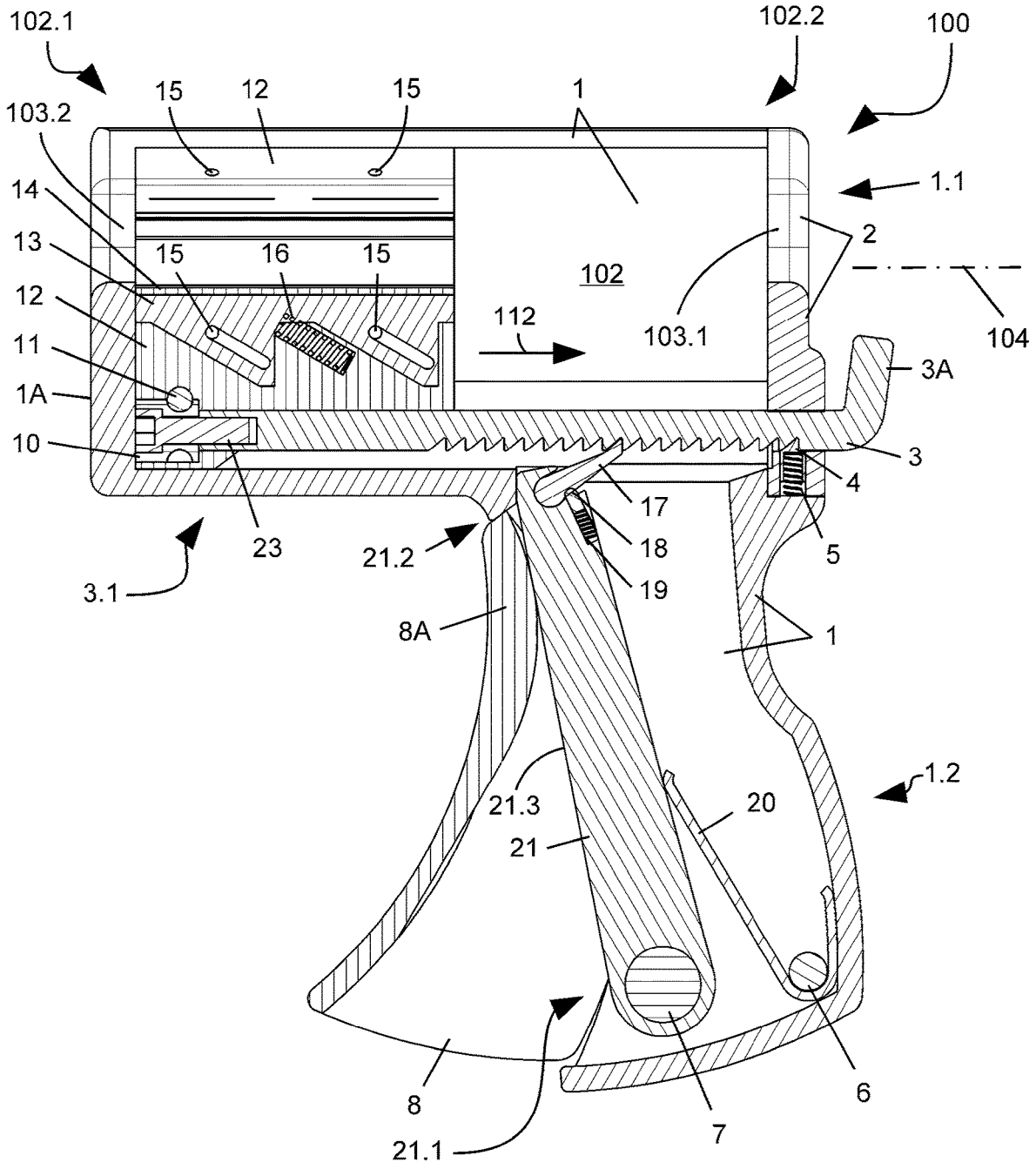
FIG. 4 is a left side elevation view, cross-section about the center-line. This view opens up the arrow puller to expose the mechanism in its forward, jaws open and squeeze trigger in its fully forward position. It is in this position that one would approach an embedded arrow.

Referring now to FIG. 4 wherein the mechanism is exposed and resting in the starting or "home" position. The three clamping jaws 13, are spring 16 loaded and kept to the jaw holder 12 by the jaw retainer pins 15. While the light jaw springs 16 continuously push the jaws 13 to the clamped or closed position, the jaws 13 are held open or unclamped only while the jaw holder 12 assembly is in this starting or "home" position. A brief look at FIG. 5 will show that this is due to the front face of the jaws 26 contacting the inside wall of the muzzle face 25 forcing the jaws open when the mechanism is pushed forward for loading of the arrow. Back to FIG. 4. As the operator begins to depress the squeeze trigger 8 and the jaw gripping surfaces 14 make contact with the arrow per the jaw springs 16, the jaw clamping ramps (which are part of the jaw 13 and jaw holder 12 profile) take over for a strong clamping action against the arrow. Paragraphs 0020 and 0021 together with their respective drawings define the crux of this devices method of grasping the vast array of available arrows.

Staying with FIG. 4, a short description of each component is in order before continuing the process path. The frame 1 is comprised of the barrel and pistol grip which hold everything in a handy and ergonomic package. The breech block 2 is fastened to the frame with four machine screws to allow for assembly and serviceability. The breech block 2 also surrounds the pull rod 3 as a rear bearing and houses the ratchet lock 4 and the ratchet lock spring 5. The pull rod 3 being attached to the jaw holder 12 and having ratchet teeth on its underside are pertinent to the pulling motion on the arrow. Note the upward bend on the pull rod 3 is designed as a knob 3A allowing the pull rod 3 to be rotated, disengaging the pull rod 3 teeth. Ratchet lock 4 locks on to the pull rod 3 teeth and ratchet lock spring 5 keeps it there so as to keep the pull rod 3 from forward motion as long as the pull rod teeth are rotated down. Trigger spring 20 keeps the squeeze trigger 8 forward by pushing on the transfer arm 21 and is kept in place and made serviceable by trigger spring retainer screw 6. Transfer arm pivot screw 7 retains the transfer arm 21 while allowing it to pivot fore and aft. Squeeze trigger 8 has a specially designed cam 8A which contacts the front face of the transfer arm 21. The pull rod end screw 23 attaches the pull rod end 10 to the pull rod 3 keeping it from pulling out of the jaw holder 12 in the rearward direction. The pull rod end keeper pin 11 keeps the pull rod end 10 from pushing out of the jaw holder 12 in the forward direction while still allowing the pull rod 3 to rotate by its bent knob 3A. The jaws 13, jaw grips 14 and the jaw springs 16 all work in unison to grasp the arrow. The ratchet pawl 17 is retained by the transfer arm 21 and pivots up and down while the ratchet pawl spring plunger 18 and ratchet pawl spring 19 push it to its upmost position.

Figure 5:
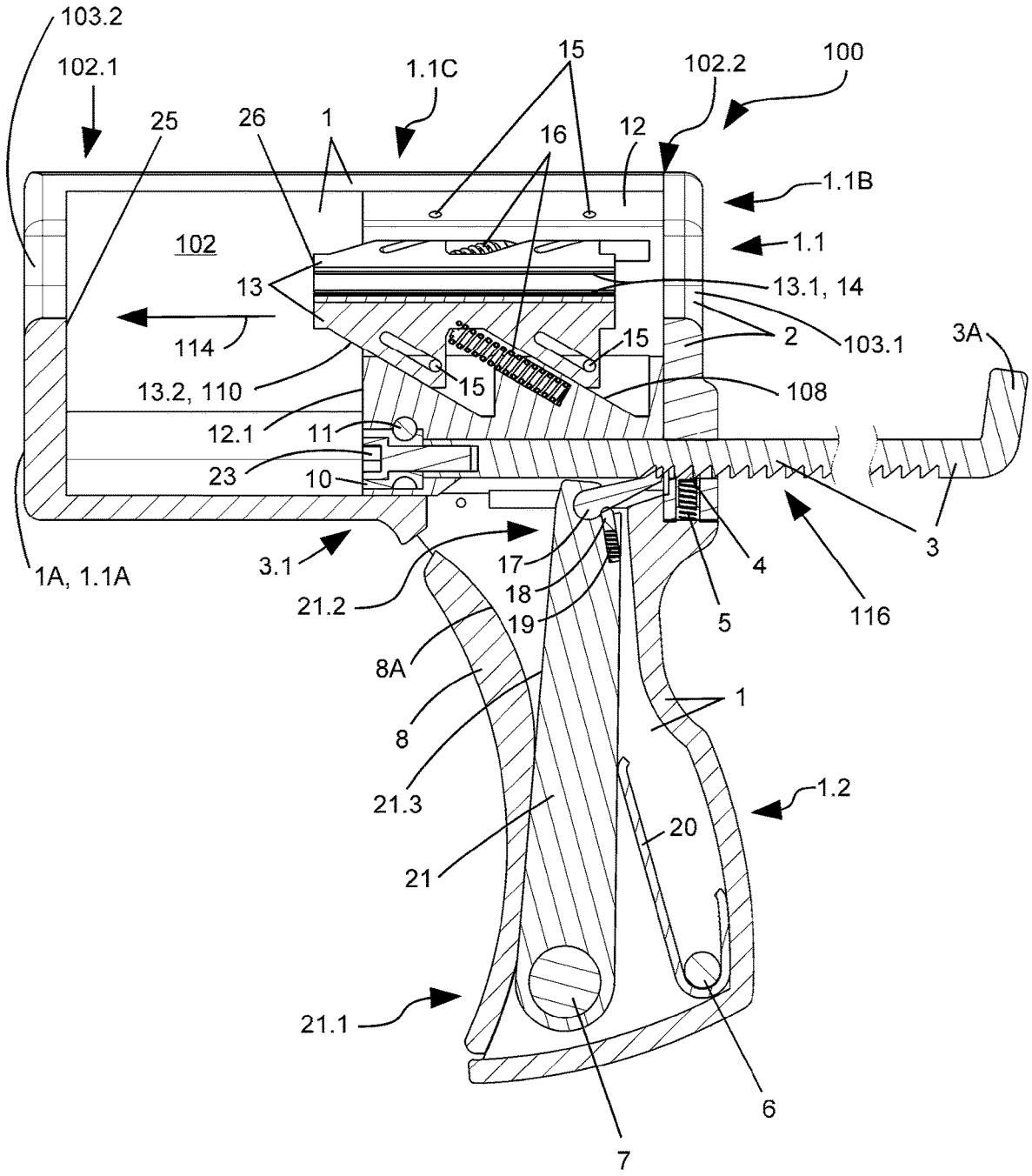
FIG. 5 is the same left side elevation view cross-section as FIG. 4 with the exception that the mechanism is now depicted at its rear most position, jaws closed and with the squeeze trigger fully depressed.

FIG. 5 shows all the components of FIG. 4 except that the mechanism is now depicted at its rear most position, jaws closed and with the squeeze trigger fully depressed.

Figure 6:
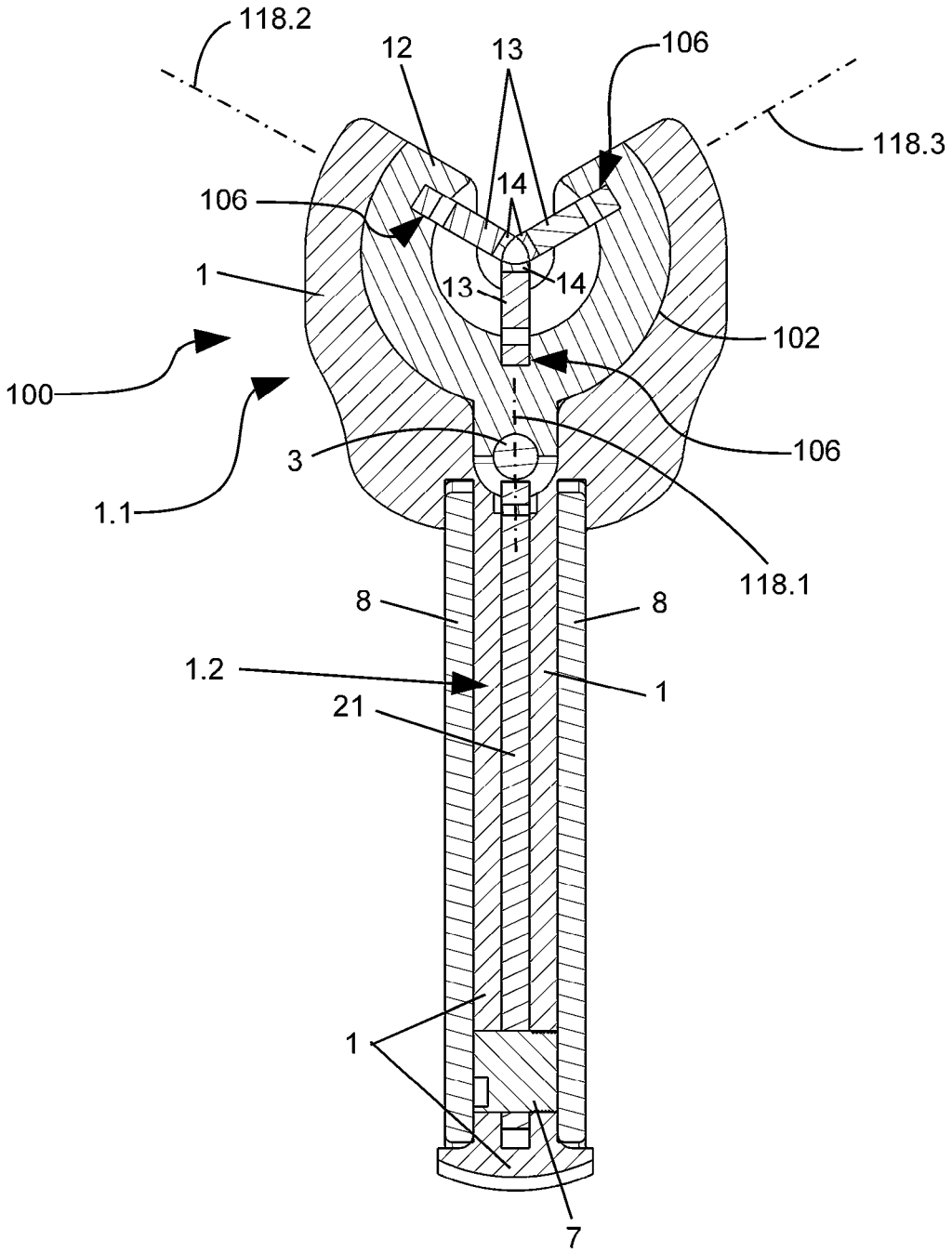
FIG. 6 is a rear elevation view, cross-section cut through the pistol grip in which the main purpose is to expose the sandwiching fit of the frame, squeeze trigger and the transfer arm.

FIG. 6 is a rear elevation view, cross-section cut through the pistol grip in which the main purpose is to expose the sandwiching fit of the frame 1, squeeze trigger 8 and the transfer arm 21. Also referenced here are the jaw holder 12, jaws 13, jaw grips 14 and the transfer arm pivot screw 7.

Figure 7A:
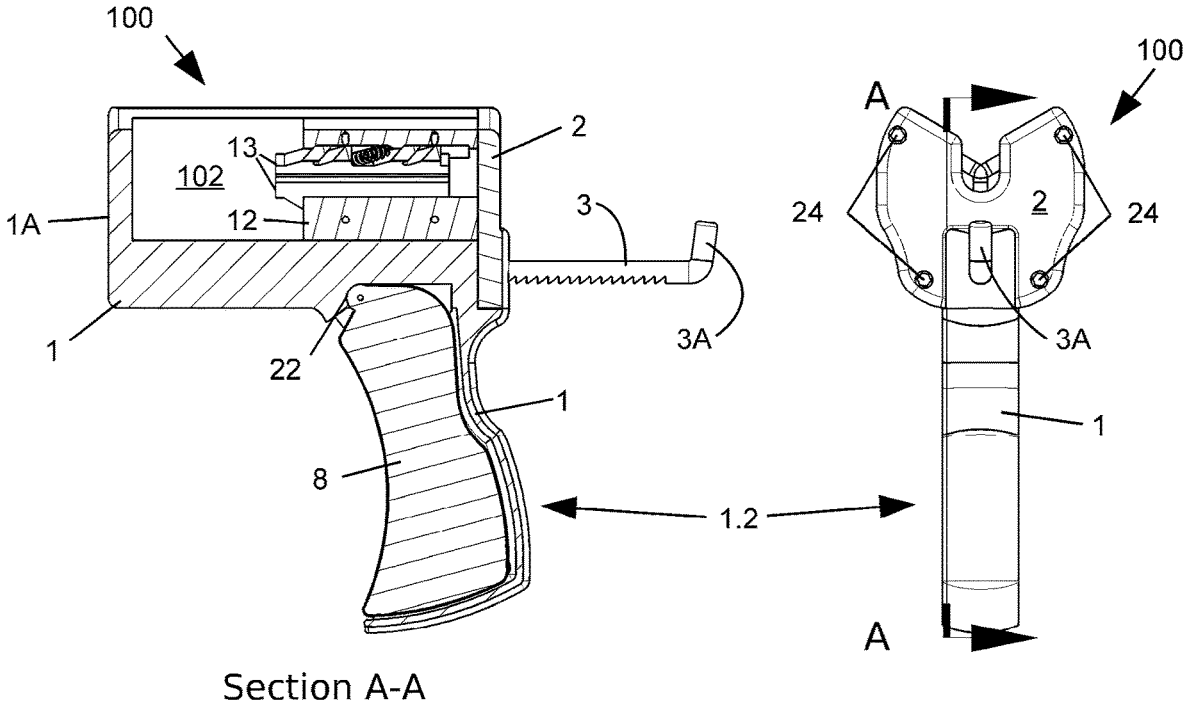
FIG. 7A is a rear elevation view showing the four breech block screws which are pertinent to assembly of the arrow puller. Also section A is cut precisely to reveal the otherwise hidden pivot boss of the squeeze trigger shown in cross Section A-A.

FIG. 7A references the four breech block mounting screws 24 essential for assembly/service of the device. FIG. 7A Section A-A references the frame 1 and the squeeze trigger 8 but especially provides a look at the squeeze trigger pivot boss 22 otherwise hidden in all other views.

Figure 7B:
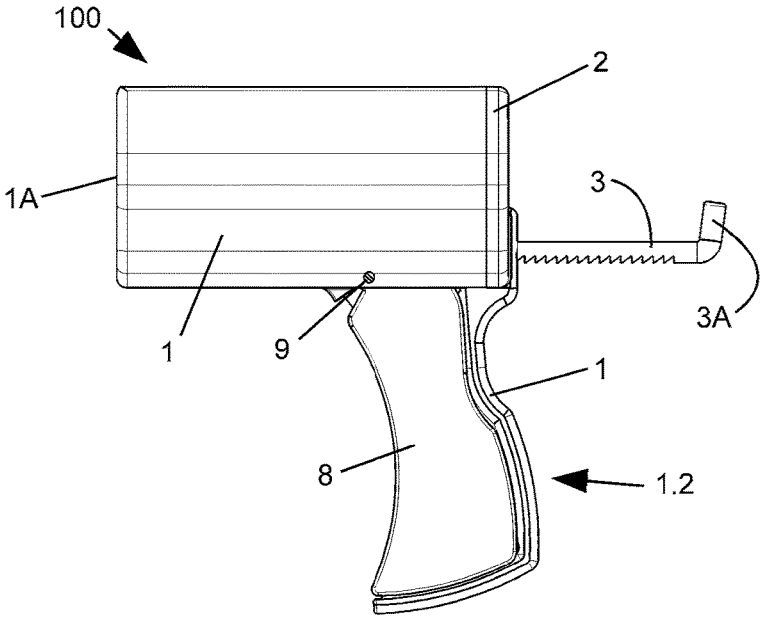
FIG. 7B is the same left side elevation view as cross Section A-A but without the cross section cut so as to show the squeeze trigger retainer screw.

FIG. 7B references the squeeze trigger retainer screw 9 so as to confirm the difference from the squeeze trigger pivot boss 22 referenced in FIG. 7A.

Returning back to the process based definition, where the majority of references will be realized in FIG. 4. The operator, guided by the angled reliefs and U shaped guides built into the muzzle face 1A and breech block 2, (see FIG. 1 briefly) places the device in position around the arrow shaft and pushes the muzzle face 1A against the said target and begins to depress the squeeze trigger 8 (back to FIG. 4). As the squeeze trigger 8 is depressed, the jaw holder assembly 3, 3A, 10, 11, 12, 13, 14, 15, 16, 23 begins to slide rearward. This is achieved through a tuned variable fulcrum mechanical advantage that starts out very powerful (most leverage albeit least motion) and progressively changes (most motion albeit least leverage). This is to ensure maximum leverage/power at the initial stage of arrow extraction where it must overcome the "friction weld" discussed in detail in paragraph 0003 of this specification. The squeeze trigger 8 swivels around its pivot boss 22 (see FIG. 7A briefly) as the operator depresses it. A special cam lobe 8A (back to FIG. 4) designed as part of the squeeze trigger 8 is responsible for the variable fulcrum mechanical advantage mentioned above as it contacts the transfer arm 21 near the top at first then progressively contacts the transfer arm 21 closer to its pivot point as the squeeze trigger 8 is depressed. The transfer arm 21 pivots around the transfer arm pivot screw 7 which allows for assembly/serviceability as well. While this rearward motion starts out slow and powerful as needed for the initial "break free" of the arrow, the tuned variable fulcrum speeds up the rearward motion substantially so as to not require an excessive number of trigger squeezes by the operator. To continue through this mechanical process, the transfer arm 21 pivots rearward to its full extent with every full depression of the squeeze trigger 8. However, this is not enough travel to bring the entire jaw holder assembly 3, 3A, 10, 11, 12, 13, 14, 15, 16, 23 to its rearmost position. It takes approximately two and a half pulls of the squeeze trigger to move the jaw holder assembly to its rearward most position as seen in FIG. 5. Back to FIG. 4, and the next step in the kinematics. The transfer arm 21 swivels rearward while the engagement of the ratchet pawl 17 to the teeth of the pull rod 3 is ensured by the ratchet pawl spring plunger 18 and its ratchet pawl spring 19. As the ratchet pawl 17 is forced rearward by the rearward pivot of the transfer arm 21 (which in turn compresses the trigger spring 20), so too is the pull rod 3 all taking place due to the operator depressing squeeze trigger 8. The trigger spring 20, retained and serviceable by the trigger spring retainer screw 6 returns the squeeze trigger 8 and the transfer arm 21 forward after the release of the squeeze trigger 8. As the pull rod 3 is leveraged rearward with each trigger squeeze, the ratchet lock 4 and the ratchet lock spring 5 ensure that the jaw holder assembly 3, 3A, 10, 11, 12, 13, 14, 15, 16, 23 won't move forward until the extraction process is over as the ratchet lock 4 engages the teeth of the pull rod 3. Once the jaw holder 12 reaches its full rearward position (see FIG. 5) it has traveled about two inches. If this is not enough extraction travel to completely remove the arrow (many variables contribute to embedded arrow depth), the operator can easily complete the task as she has already broken the "friction weld" between the arrow and the target and pulled the arrow the crucial distance from its lodging. At this point the operator has a nice pistol grip for a very easy pull. Obviously this design could easily be made longer to ensure the arrow is removed 100%, but that could take several more unneeded pulls of the squeeze trigger. Or the operator could release the clamp, push the arrow puller forward to the target again (get another bite) and start pulling the squeeze trigger again. Here a balance was struck between any need for a longer pull vs. the necessity for continued squeezing of the trigger when the arrow is already basically freed. Size, weight, portability etc. were contemplated as well.

To remove the arrow from the arrow puller after successfully extracting an arrow from a target refer again to FIG. 4. This procedure is the only time where it is convenient (but not mandatory) to use two hands with this device. The operator need only to rotate the pull rod 3 by the bent upward knob 3A in either direction to disengage the pull rod 3 teeth from the ratchet pawl 17 and the ratchet lock 4 and then push the pull rod all the way forward to the home position, opening the three jaws 13 automatically as the jaws front face 26 (see FIG. 5) meet the muzzle interior wall 25 and the jaws move open, compressing the jaw springs. Back to FIG. 4, all that is left in the process is to rotate the pull rod knob 3A back to the upright position so the ratchet lock 4 re-engages the teeth of the pull rod 3 therein holding the jaw holder 12 forward and jaws 13 open for another arrow.

While explaining this arrow puller device in words has turned out quite verbose, in reality the process explained herein takes only about 5 or 10 seconds to execute.

Referring to FIGS. 1-3A and 4-7B, the above-described arrow puller provides for pulling an arrow from a target by pulling on the shaft 101 of the arrow, and accordingly, the arrow puller may generally be characterized as a shaft puller 100. The frame 1 of the shaft puller 100 incorporates a body portion 1.1 and a handle portion 1.2, wherein the body portion 1.1 incorporates a muzzle endwall portion 1.1A, a removeable breech endwall portion 2, and a longitudinal bore 102 extending along and within the body portion 1.1 from a first end 102.1 of the longitudinal bore 102.2 proximate to the muzzle endwall portion 1.1A, to a second end 102.2 of the longitudinal bore 102.2 proximate to the breech endwall portion 2. A first side 1.1B of body portion 1.1—i.e. a top side 1.1B—incorporates an opening 1.1C therethrough that in cooperation with associated respective slots 103.1, 103.2 in the breech 2 and muzzle 1.1A endwall portions, respectively, provide for placing the body portion 1.1 of the shaft puller 100 around a shaft 101 to be pulled, and thereby locate the shaft 101 along a pull axis 104 of the shaft puller 100. The shaft puller 100 further incorporates a jaw holder 12 that is axially-slideable within, and along, the longitudinal bore 102 of the body portion 1.1 of the frame 1, wherein the jaw holder 12 incorporates a plurality of three radial slots 106 that cooperate with a corresponding plurality of three jaws 13, wherein each radial slot 106 and associated jaw 13 is oriented along a corresponding different radial axis 118.1, 118.2, 118.3 relative to one another at a corresponding different angular position with respect to, and around, the pull axis 104 of the shaft puller 100. The radially-inboard side 13.1 of each jaw 13 incorporates a jaw gripping surface 14, and a radially-outboard side 13.2 of the jaw 13 incorporates a plurality of angled jaw-clamping ramps 110, that cooperate with corresponding angled jaw-clamping ramps 108 within the corresponding radial slot 106 of the jaw holder 12 within which the jaw 13 is located. The jaw holder 12 is axially-moved along the longitudinal bore 102 responsive to action of a pull rod 3, a first end 3.1 of which is operatively coupled to the jaw holder 12. The pull rod 3 provides for moving the jaw holder 12 in a direction 112—also referred to as a pull direction 112—towards the breech endwall portion 2 of the body portion 1.1 of the frame 1 responsive to a pulling thereof by the ratchet pawl 17 operatively coupled to a second end 21.2 of the transfer arm 21, a first end 21.1 of which is pivoted about the transfer arm pivot screw 7 along a pivot axis within the handle portion 1.2 of the frame 1, wherein the ratchet pawl 17 interacts with a ratchet-teeth portion 116 of the pull rod 3 responsive to a rotation of the transfer arm 21 responsive to action by the cam lobe 8A of the squeeze trigger 8 on a side 21.3 of the transfer arm 21. The pull rod 3 provides for moving the jaw holder 12 in a direction 114—also referred to as a push direction 114—towards the muzzle endwall portion 1.1A of the body portion 1.1 of the frame 1 responsive to a manual pushing of the knob 3A of the pull rod 3, so as to provide for moving a muzzle-endwall-facing end face of jaw holder 12.1 in sufficient proximity to, or in abutment with, an inside wall 25 of the muzzle endwall portion 1.1A of the body portion 1.1 of the frame 1, so as to provide for opening the plurality of three jaws 13 so as to provide for receiving, within the plurality of three jaws 13, a shaft 101 to be pulled.

After describing the embodiment of this invention in precise detail, it is to be understood that while this design was actually produced in a working proof of concept prototype of the subtractive manufacturing method. This was not meant in any way to limit the methods, size, shape, materials or arrangement of components used to accomplish its means. The drawings depict a certain design but this is not an application for a design patent. This application is being submitted as a utility patent and it must not impose limits on the method of manufacture. Additive manufacturing, plastic injection molding, sheet metal stamping and others could be used as well to produce a device that functions as this device and its utility is intended.

The invention claimed is:

1. An archery arrow puller for pulling an archery arrow or bolt from a material pierced thereby, comprising:

a. a frame, wherein said frame comprises:

i. a body portion comprising:

a) a longitudinal bore;

b) a muzzle endwall portion abutting a first end of said longitudinal bore; and c) a breech endwall portion abutting a second end of said longitudinal bore, wherein each of said breech endwall portion and said muzzle endwall portion is slotted so as to provide for accepting a shaft of an archery arrow or bolt to be pulled; and a first side of said body portion incorporates an opening which in cooperation with said slotted breech and muzzle endwall portions provides for said shaft of said archery arrow or bolt to be received within said longitudinal bore and located along a pull axis of the archery arrow puller within said longitudinal bore; and ii. a handle portion depending from said body portion;

b. a jaw holder assembly configured to slide within said longitudinal bore of said body portion of said frame, wherein said jaw holder assembly comprises:

i. a jaw holder comprising a plurality of three radial slots distributed around said pull axis, wherein each radial slot of said plurality of three radial slots incorporates a plurality of first angled jaw-clamping ramps;

ii. a plurality of three jaws, wherein each jaw of said plurality of three jaws cooperates with a corresponding radial slot of said plurality of three radial slots of said jaw holder, each said jaw incorporates a shaft-gripping surface on a radially-inboard side of said jaw, and incorporates a plurality of second angled jaw-clamping ramps on a radially-outboard side of said jaw, said plurality of second angled jaw-clamping ramps on said radially-outboard side of each said jaw cooperate with a corresponding said plurality of first angled jaw-clamping ramps of a corresponding said radial slot in engagement therewith, so as to provide for moving said jaw radially inboard towards said pull axis responsive to a motion of said jaw holder in a first direction towards said breech endwall portion relative to said jaw, or responsive to a motion of said jaw in a second direction towards said muzzle endwall portion of said frame relative to said jaw holder;

iii. a plurality of three bias-springs, wherein each bias-spring of said plurality of three bias-springs is operative between said jaw holder and a corresponding said jaw of said plurality of three jaws; and iv. a pull rod, wherein said pull rod extends through said breech endwall portion, a first end of said pull rod is operatively coupled to said jaw holder at a location within said body portion of said frame, a second end of said pull rod extends through said breech endwall portion, and said pull rod provides for pulling said jaw holder towards said breech endwall portion of said frame to pull said shaft from the material pierced by said shaft; and c. a squeeze-trigger-actuated ratchet mechanism that provides for engaging with and translating said pull rod so as to cause said jaw holder assembly operatively coupled thereto to translate along said longitudinal bore towards said second end thereof.

2. An archery arrow puller for pulling an archery arrow or bolt from a material pierced thereby as recited in claim 1, wherein said squeeze-trigger-actuated ratchet mechanism comprises:

a. a transfer arm within said handle portion of said frame, wherein a first end of said transfer arm is pivoted from said handle portion of said frame at a location therein that is relatively distal to said pull rod, a second end of said transfer arm incorporates a spring-biased ratchet pawl that provides for engaging a ratchet-teeth portion of said pull rod when moved in a pull direction of said pull rod, and provides for not engaging with said ratchet-teeth portion of said pull rod when moved in a push direction of said pull rod, and b. a squeeze trigger pivoted from said handle portion of said frame at a location relatively proximal to said pull rod, wherein said squeeze trigger extends along a length of said handle portion of said frame, and said squeeze trigger incorporates a cam lobe that engages with said transfer arm to provide for rotating said transfer arm responsive to a rotation of said squeeze trigger.

3. An archery arrow puller for pulling an archery arrow or bolt from a material pierced thereby as recited in claim 2, wherein said cam lobe of said squeeze trigger is shaped so as to provide for progressively decreasing leverage on said transfer arm, and progressively increasing rotational travel of said transfer arm responsive to said rotation of said squeeze trigger.

4. An archery arrow puller for pulling an archery arrow or bolt from a material pierced thereby as recited in claim 2, further comprising a transfer-arm bias spring within said handle portion of said frame, operative between said transfer arm and said frame to provide for biasing said squeeze trigger away from said handle portion of said frame.

5. An archery arrow puller for pulling an archery arrow or bolt from a material pierced thereby as recited in claim 2, further comprising a spring-biased ratchet lock operative between said frame and said ratchet-teeth portion of said pull rod, wherein said spring-biased ratchet lock provides for restraining motion of said pull rod in said push direction, and said spring-biased ratchet lock provides for enabling motion of said pull rod in said pull direction.

6. An archery arrow puller for pulling an archery arrow or bolt from a material pierced thereby as recited in claim 2, wherein said first end of said pull rod is operatively coupled to said jaw holder with a pull rod end keeper pin that provides for said pull rod to be rotated with respect to said jaw holder so as to provide for controlling an engagement of said ratchet-teeth portion of said pull rod with said spring-biased ratchet pawl.

7. An archery arrow puller for pulling an archery arrow or bolt from a material pierced thereby as recited in claim 1, wherein said shaft-gripping surface of each said jaw incorporates a medium to low durometer rubber or other semi-tacky material.

8. An archery arrow puller for pulling an archery arrow or bolt from a material pierced thereby as recited in claim 1, wherein when fully biased by a corresponding said bias-spring towards said muzzle endwall portion of said frame, an end face of each said jaw is biased so as to extend beyond a muzzle-endwall-facing end face of said jaw holder so as to provide for opening said plurality of three jaws when said jaw holder is pushed against an inside wall of said muzzle endwall portion of said frame.

9. An archery arrow puller for pulling an archery arrow or bolt from a material pierced thereby as recited in claim 8, wherein said pull rod provides for pushing said jaw holder towards said muzzle endwall portion of said frame prior to engagement of said archery arrow puller with said shaft of said archery arrow or bolt to be pulled, responsive to manually pushing on said second end of said pull rod until said end face of each said jaw contacts said inside wall of said muzzle endwall portion of said frame, after which each said jaw opens radially outward relative to said pull axis responsive to further movement of said jaw holder towards said muzzle endwall portion of said frame in opposition to said a spring-bias force from a corresponding said bias-spring associated with said jaw.

10. An archery arrow puller for pulling an archery arrow or bolt from a material pierced thereby as recited in claim 1, wherein for each said jaw of said plurality of three jaws, said jaw, said second angled jaw-clamping ramps of said jaw, and said first angled jaw-clamping ramps of said corresponding radial slot of said jaw holder are configured so that said shaft-gripping surface of said jaw is parallel to said pull axis and remains parallel to said pull axis independent of a relative axial position of said jaw with respect to said jaw holder and with respect to said frame.

11. A method of pulling an archery arrow or bolt from a material pierced thereby, comprising:

a. placing of a longitudinal bore of a frame of an archery arrow puller around a shaft of an archery arrow or bolt to be pulled from the material pierced thereby, wherein the operation of placing said longitudinal bore of said frame of said archery arrow puller around said shaft comprises sliding slotted portions of muzzle and breech endwall portions of said frame over said shaft with said muzzle endwall portion of said frame facing said material pierced thereby, wherein said slotted portions of said muzzle and breech endwall portions are aligned with and surround a pull axis of said archery arrow puller;

b. biasing each jaw of a plurality of three jaws in a first direction towards said muzzle endwall portion of said frame with a corresponding associated spring-bias force, wherein each jaw of said plurality of three jaws is operatively associated with a corresponding radial slot of a plurality of radial slots in an associated jaw holder within said longitudinal bore of said frame, each said jaw is located along a different radial axis relative to one another at a corresponding different angular position about said pull axis so as to provide for clamping said shaft between said plurality of three jaws when said jaws are moved radially inwards towards said pull axis, each said jaw comprises a shaft-gripping surface on a radially-inboard side of said jaw, and a plurality of first angled jaw-clamping ramps on a radially-outboard side of said jaw, each said corresponding radial slot incorporates a plurality of second angled jaw-clamping ramps that cooperate with corresponding said plurality of first angled jaw-clamping ramps on said radially-outboard side of said jaw in engagement therewith, so as to provide for moving said jaw radially inboard towards said pull axis responsive to a motion of said jaw holder in a second direction towards said breech endwall portion relative to said jaw, or responsive to a motion of said jaw in said first direction towards said muzzle endwall portion of said frame relative to said jaw holder; and c. moving said jaw holder toward said breech endwall portion of said frame, thereby causing each said jaw to move radially inwards towards said pull axis and thereby clamp against said shaft responsive to the action of said plurality of first angled jaw-clamping ramps of said each said jaw sliding relative to corresponding said plurality of second angled jaw-clamping ramps associated with said corresponding radial slot while simultaneously causing each said jaw to move towards said breech endwall portion and thereby extract said shaft from said material pierced thereby following contact of said muzzle endwall portion of said frame with a surface of said material pierced by said shaft.

12. A method of pulling an archery arrow or bolt from a material pierced thereby as recited in claim 11, further comprising forwardly positioning said jaw holder within said longitudinal bore of said frame so as to cause an end face of each said jaw of said plurality of three jaws to abut an inside surface of said muzzle endwall portion of said frame and then translate aftwards relative to said jaw holder in opposition to said corresponding associated spring-bias force, so that a translation of each said jaw relative to said jaw holder responsive to the operation of forwardly positioning said jaw holder provides for opening said plurality of three jaws to provide for receiving said shaft within said plurality of three jaws.

13. A method of pulling an archery arrow or bolt from a material pierced thereby as recited in claim 11, wherein the operation of moving said jaw holder towards said breech endwall portion of said frame comprises applying a force to a side of a transfer arm, wherein a first end of said transfer arm is pivoted from a handle portion of said frame, a second end of said transfer arm is operatively coupled to a pull rod with a spring-biased ratchet pawl in cooperation with a ratchet-teeth portion of said pull rod, wherein said pull rod is operatively coupled to said jaw holder, said spring-biased ratchet pawl engages with said ratchet-teeth portion of said pull rod responsive to said force being applied in said second direction away from said muzzle endwall portion of said frame, and said spring-biased ratchet pawl disengages from said ratchet-teeth portion when said second end of said transfer arm is moved in said first direction towards said muzzle endwall portion of said frame.

14. A method of pulling an archery arrow or bolt from a material pierced thereby as recited in claim 13, wherein a distance from said second end of said transfer arm of a location of said force applied to said side of said transfer arm progressively increases with increasing rotation of said transfer arm.

15. A method of pulling an archery arrow or bolt from a material pierced thereby as recited in claim 13, further comprising disengaging said ratchet-teeth portion of said pull rod from said spring-biased ratchet pawl by rotating said pull rod so as to provide for pushing said jaw holder towards said muzzle endwall portion of said frame.

16. A method of pulling an archery arrow or bolt from a material pierced thereby as recited in claim 11, wherein said shaft-gripping surface of each said jaw comprises a medium to low durometer rubber or other semi-tacky material.

17. A method of pulling an archery arrow or bolt from a material pierced thereby as recited in claim 11, further comprising retaining each of said plurality of three jaws in said jaw holder with a corresponding at least one jaw retainer pin, wherein the operation of retaining each of said plurality of three jaws does not interfere with a relative motion of each said jaw within said corresponding radial slot while said plurality of first angled jaw-clamping ramps of said jaw are in engagement with corresponding said plurality of second angled jaw-clamping ramps of said jaw holder.

18. A method of pulling an archery arrow or bolt from a material pierced thereby as recited in claim 11, further comprising maintaining each said shaft-gripping surface of each said jaw in parallelism with said pull axis independent of a motion of said each said jaw relative to said jaw holder and relative to said frame.

* * * * *